US005477987A

United States Patent [19]

Keller

[11] Patent Number: 5,477,987

[45] Date of Patent: Dec. 26, 1995

[54] DISPENSING APPLIANCE FOR AT LEAST TWO COMPONENTS

[76] Inventor: Wilhelm A. Keller, Obstgartenweg 9, CH-6402 Merlischachen, Switzerland

[21] Appl. No.: 181,919

[22] Filed: Jan. 18, 1994

[30] Foreign Application Priority Data

Jan. 15, 1993 [CH] Switzerland ..... 00121/93

[51] Int. Cl.[6] ..... B67D 5/42

[52] U.S. Cl. ..... 222/137; 222/326; 222/389

[58] Field of Search ..... 222/137, 145, 222/180, 334, 389, 309, 326, 327, 611.1, 611.2; 239/751; 401/48

[56] References Cited

U.S. PATENT DOCUMENTS

| | | | |
|---|---|---|---|
| 2,652,955 | 9/1953 | Crewe | 222/327 |
| 2,822,959 | 2/1958 | Soehnlen et al. | 222/327 |
| 4,690,306 | 9/1987 | Stäheli | 222/137 |
| 4,854,482 | 8/1989 | Bergner | 222/389 |
| 4,871,088 | 10/1989 | Cox | 222/137 |
| 4,911,328 | 3/1990 | Keller | 222/389 |
| 5,020,693 | 6/1991 | Ernst et al. | 222/309 |
| 5,092,492 | 3/1992 | Centea | 222/309 |
| 5,104,005 | 4/1992 | Schneider, Jr. et al. | 222/137 |
| 5,137,181 | 8/1992 | Keller | 222/134 |
| 5,228,605 | 7/1993 | Schlichenmaier | 222/611.1 |
| 5,263,614 | 11/1993 | Jacobsen et al. | 222/137 |
| 5,277,333 | 1/1994 | Shimano | 222/14 |
| 5,392,956 | 2/1995 | Keller | 222/1 |

FOREIGN PATENT DOCUMENTS

| | | |
|---|---|---|
| 408494A1 | 1/1991 | European Pat. Off. . |
| 3440893 | 5/1986 | Germany . |
| 2759/92 | 9/1992 | Switzerland . |
| 2758/92 | 9/1992 | Switzerland . |
| WO91/05731 | 5/1991 | WIPO . |
| WO9220460 | 11/1992 | WIPO . |

*Primary Examiner*—Andres Kashnikow
*Assistant Examiner*—Philippe Derakshani
*Attorney, Agent, or Firm*—Marks & Murase

[57] ABSTRACT

The dispensing appliance for at least two components comprises a respective pump assembly for each component, each of said pumps being connected to a detachable container holding one of said components, and the pump outlets ending in a common but divorced outlet. Said pump assemblies are held in a frame which can be dismantled and reassembled, and the cylinders of said pump assemblies are composed of different segments.

Such an appliance is compact and allows an easy change of metering ratios, simplified manufacture and cleaning.

27 Claims, 6 Drawing Sheets

3
63
15
63
16
6
8
23
25
26
24
10
11
1
13
4
12
45
4
14
32
18
21
17
21
27
19
90
20
90
27
14b
5
14a
VI
VI
2
9
22
7
65
64

DISPENSING APPLIANCE FOR AT LEAST TWO COMPONENTS

BACKGROUND OF THE INVENTION

The present invention refers to a dispensing appliance for at least two components, in particular a compact hand-held appliance, comprising a respective pump assembly for each component, each of the pumps being connected to a detachable container which holds one of the components, and the outlets of the pumps ending in a common outlet. Such an appliance is known from PCT/GB92/00813 (which corresponds to U.S. Pat. No. 5,277,333), which refers primarily to the storage container while the design of the pump assembly is being described quite summarily. U.S. Pat. No. 4,690,306 discloses a method and device for storing, mixing and dispensing of at least two fluid substances, wherein the device is assembled in a sort of frame with relatively complicated pieces and spring means, and the containers are disposable.

SUMMARY OF THE INVENTION

On the base of this prior art, it is the object of the present invention to provide a pump-like dispensing appliance as mentioned above which offers an increased efficiency and is suitable for different types of drives, and which is easy to manufacture as well as, on the other hand, easy to disassemble. This object is attained by means of an appliance wherein the pump assemblies are held in a frame which can be dismantled and reassembled, comprising a respective pump assembly for each component, each of the pumps being connected to a detachable container which holds one of the components, and the outlets of the pumps ending in a common outlet.

BRIEF DESCRIPTION OF THE DRAWINGS

The invention will be explained in more detail hereinafter with reference to a drawing of embodiments.

DETAILED DESCRIPTION OF THE INVENTION

Figure 1:
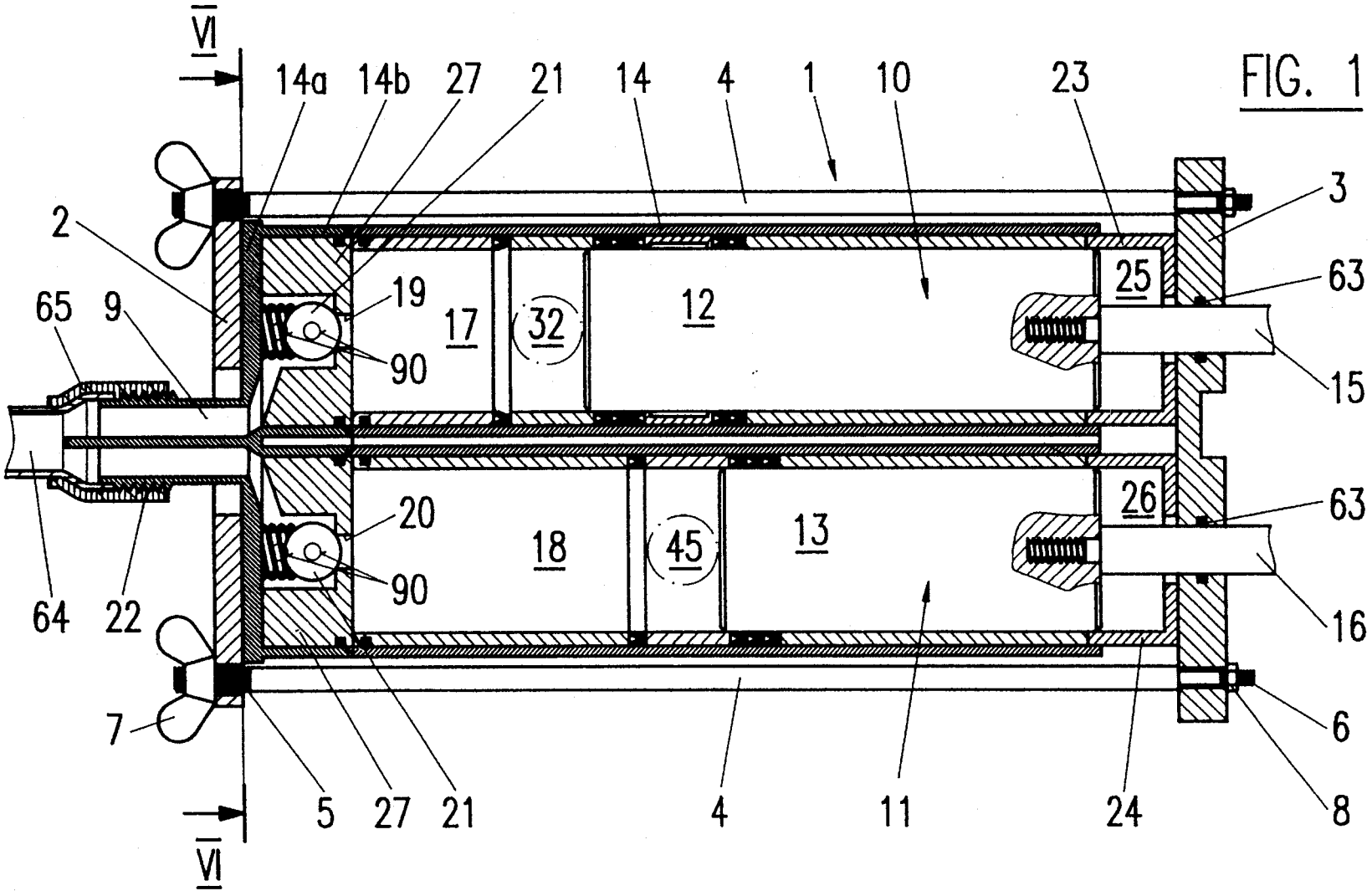
FIG. 1 shows a part of the dispensing appliance of the invention with two distinct pump assemblies in a sectional view.

FIGS. 1 to 3 and 7 each show two different examples of possible pump assemblies, the remaining component parts being present in all appliances. In a given appliance, the respective pump pistons have equal lengths and strokes; their diameters, however, may be different. Moreover, in FIGS. 1, 2 and 3, respectively, the portion of an appliance on its dispensing side is schematically shown, which is independent from the drive, i.e. the drive shafts of the pump pistons can be driven pneumatically, electrically or manually.

The pump portion comprises a frame 1 which is substantially composed of a front frame plate 2 and a rear frame plate 3 which are connected by several, at least two opposing frame rods 4 which are provided both at the front and at the rear with threaded portions 5 and 6, respectively, to each of which a respective wing nut 7 is screwed at the front and a respective hexagon nut, for example, at the back. Three frame rods may, e.g., be provided, as indicated in schematical FIG. 5. Moreover, other types of adjustable attachments and actuating devices of the frame rods to the frame plates are possible. It should be mentioned that the term "front" refers to the side of common outlet 9 and the term "rear" to the drive side, as far as this application is concerned.

Frame 1 accommodates the two distinct pump assemblies 10 and 11 with pistons of different lengths 12 and 13, in order to show two embodiments in a single figure. The pump assemblies are disposed in a common, twin-cylinder shaped housing 14 to whose front end 14*a* common outlet 9 is secured. The front part 14*b* containing front end 14*a* is advantageously separable from the rest of the housing for facilitating to service the front seals and in particular the front check valves. Secured to pistons 12 and 13 are respective drive shafts 15 and 16 which are connected, as mentioned above, to any kind of drive. The two cylinders 17 and 18 are provided with respective outlets 19 and 20 each of which is sealed by a spring-loaded valve ball 21. The two outlets 19 and 20 remain separated even in common outlet tube 9. The latter can be provided, e.g., with a static mixer 64 which serves the purpose of mixing the media and to start a corresponding reaction, and which is screwed on by means of threaded portion 22 and a union nut 65. When using cylinders of different cross-sections, it is advantageous to provide the two outlet channels 19 and 20 with different cross-sections which are adapted to the piston cross-sections.

Figure 3:
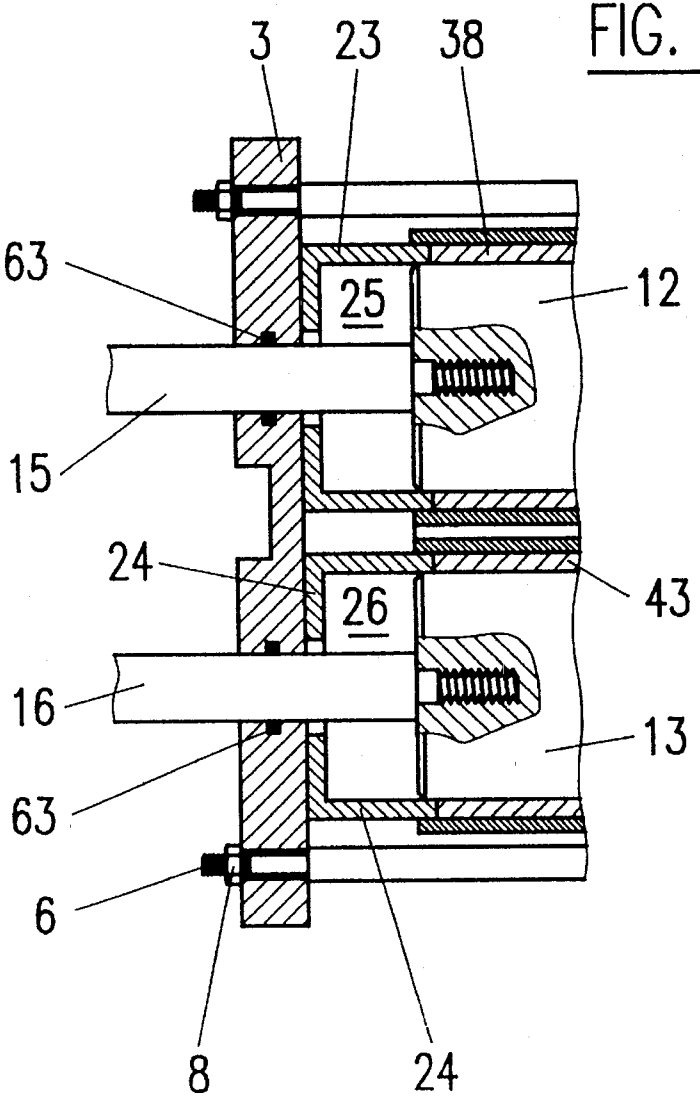

In the condition illustrated in FIG. 1, the two pistons are in their rear end positions, and it appears in FIGS. 1 or 3 that between the rear end of the pistons and the closures 23 and 24 of the cylinders, respective compartments 25 and 26 are formed which are designed as leakage compartments in order to collect quantities of material which may possibly leak out if the sealing is imperfect. For adjusting the piston or pistons axially forwards or backwards to assure both pumps commence metering at precisely the same time, the rear end of the piston or pistons may comprise holes around its circumference for an adjustment key. As appears in FIG. 3, in particular, the leakage compartments are not integral with the cylinders but are arranged in a dismountable manner. The leakage compartments are primarily intended to keep any amount of material from passing to the outside and to contaminate the operator or the surroundings. For this purpose it is advantageous if the inside of the leakage compartments is visible from the outside in order to verify their filling levels.

Figure 2:
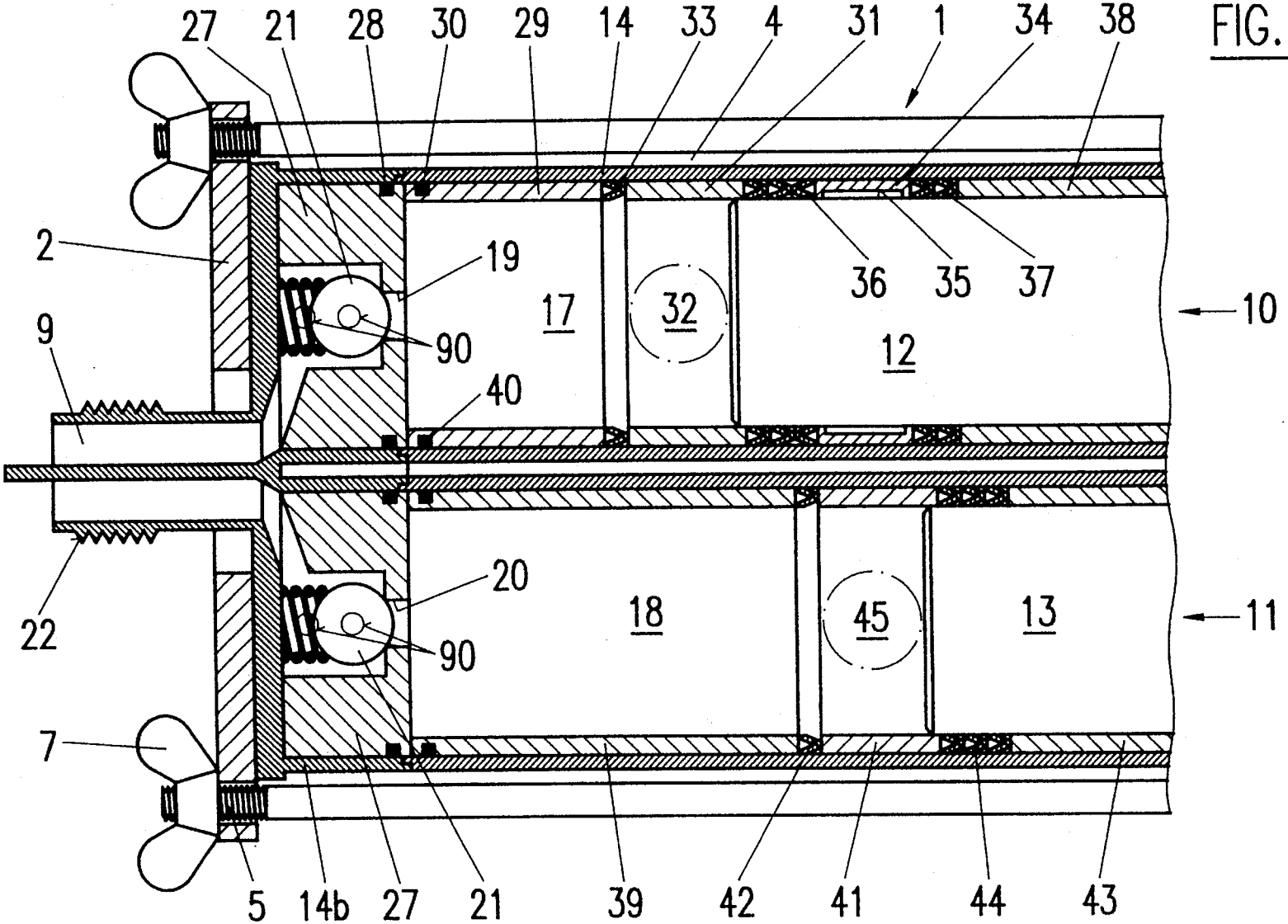
FIGS. 2 and 3 show the assembly of FIG. 1 on an enlarged scale.

It is more clearly visible in enlarged FIGS. 2 and 3 that the pump cylinders 17 and 18 are not manufactured in one piece but are composed of several cylinder segments between which seals are disposed. When comparing pump assembly 10 to pump assembly 11, it appears that the two assemblies are not identical, thus demonstrating that different alternatives are possible. Cylinder 17 of pump assembly 10 is composed, starting from the outlet end, of a cylinder head piece 27 in which spring-loaded valve ball 21 is disposed and which is provided with outlet 19 and with a seal 28, e.g. an O-ring. Adjoining thereto is a segment 29 which is also provided with a seal 30, e.g. an O-ring. Between the first segment 29 and adjoining segment 31, which is disposed in the area of inlet 32, a lip seal 33 is provided.

Figure 8:
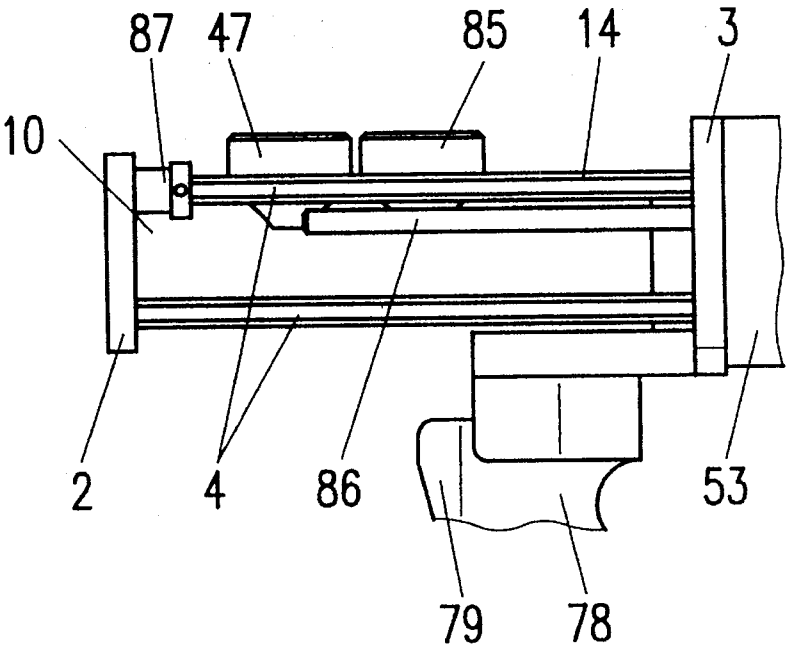
FIG. 8 shows a detail of a dispensing appliance.

A chamber segment 34 follows which, as opposed to the other ones, does not have a solid, level tube wall but is provided with an internal groove 35 which is connected to a distinct container by an inlet 85, see FIG. 8. The groove serves the purpose of wetting the piston with a liquid from the distinct container and to create a liquid barrier in order to prevent any contact of the dispensed component with air in the case that the component is of such a chemical composition as to be sensitive to air or humidity. Moreover, the liquid can serve to prevent hardening of the materials contained in the leakage compartments. It is understood that the wetting liquid will have to be chemically adapted to the dispensed component.

Seals 36 and 37 are disposed on either side of chamber segment 34, seal 37 being followed by another, fourth segment 38. The rear closure 23 of the cylinder follows the fourth segment 38, the closure forming leakage compartment 25.

As will be understood in the discussion of the second pump assembly 11, it is also possible to realize such a pump assembly without a wetting liquid and an internal groove, respectively, if a less sensitive medium is being dispensed.

The construction of second pump assembly 11 is similar to that of the first one and has a first segment 39 with a seal 40, a second segment 41 with a seal 42 between the first and the second segment, as well as a third segment 43 with a seal 44 between the second and the third segment, the third segment 43 being followed by rear cylinder closure 24 which forms leakage compartment 26. In analogy to the first inlet 32, the second pump assembly is also provided with an inlet 45. The two drive shafts 15 and 16 are guided in rear closures 23, 24 of the cylinders by sleeves and in rear end plate 3 where they are sealed by seals 63 and are secured, e.g. detachably screwed, to pistons 12 and 13.

Due to the fact that the pump cylinders are not made in one piece but in the form of segments which are not only provided with seals between them but also around the segments, pistons without seals can be used whose manufacture is thereby simplified and which result in a more efficient sealing in such appliances. For the sealing of the segments between them and with respect to the housing, other seals than the illustrated ones can be used as well.

Figure 6:
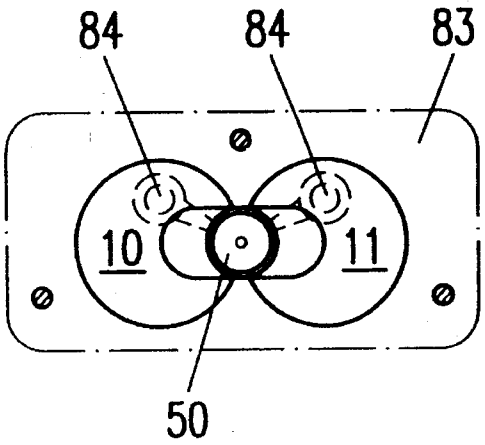
FIG. 6 shows an alternative embodiment in a sectional view according to line VI—VI in FIG. 1.

In FIG. 6, an alternative embodiment of cylinder head piece 83 is illustrated wherein the spring-loaded valve balls 84 are disposed as far upwardly as constructively possible in order to be better able to evacuate the air which accumulates in that area and which results in disturbances in operation.

It follows from the figures that the front frame plate acts upon cylinder head piece 27 by housing closure 14 and rear frame plate 3 acts upon rear closures 23 and 24 of the cylinder, in such a manner that the head piece and the rear closure and thus all the cylinder segments can be tensioned by the wing nuts or the like. This results in a possibility for adjustment and readjustment of the different seals, in particular of those seals whose sealing action is readjustable by the tensioning action.

Thus, the frame and the frame rods with nuts disposed thereon allow an easy dismantling of the pump assemblies, as well as an adjustment or readjustment of the seals.

When using more than one storage container, it is important that the inlet ports of the pump assemblies are as close to each other as possible in order to save space and to obtain short distances, as well as in order to obtain minimal tilting moments. If the inlet port were disposed in parallel to each other and perpendicularly with respect to the longitudinal axis, the two inlet ports and thus the pump cylinders would soon be far apart if storage containers with large diameters are used. According to FIG. 4 or 5, a solution allowing the use of large storage containers while maintaining a short distance between the inlet ports and the pump cylinders consists in disposing the longitudinal axes of the storage containers and thus also of the inlet ports at a certain mutual angle, e.g. at an angle of 20° to 90°, preferably between 20° and 40°. Such an arrangement also allows an attachment of a third storage container between the two others in the case of more than two pump assemblies.

Figure 4:
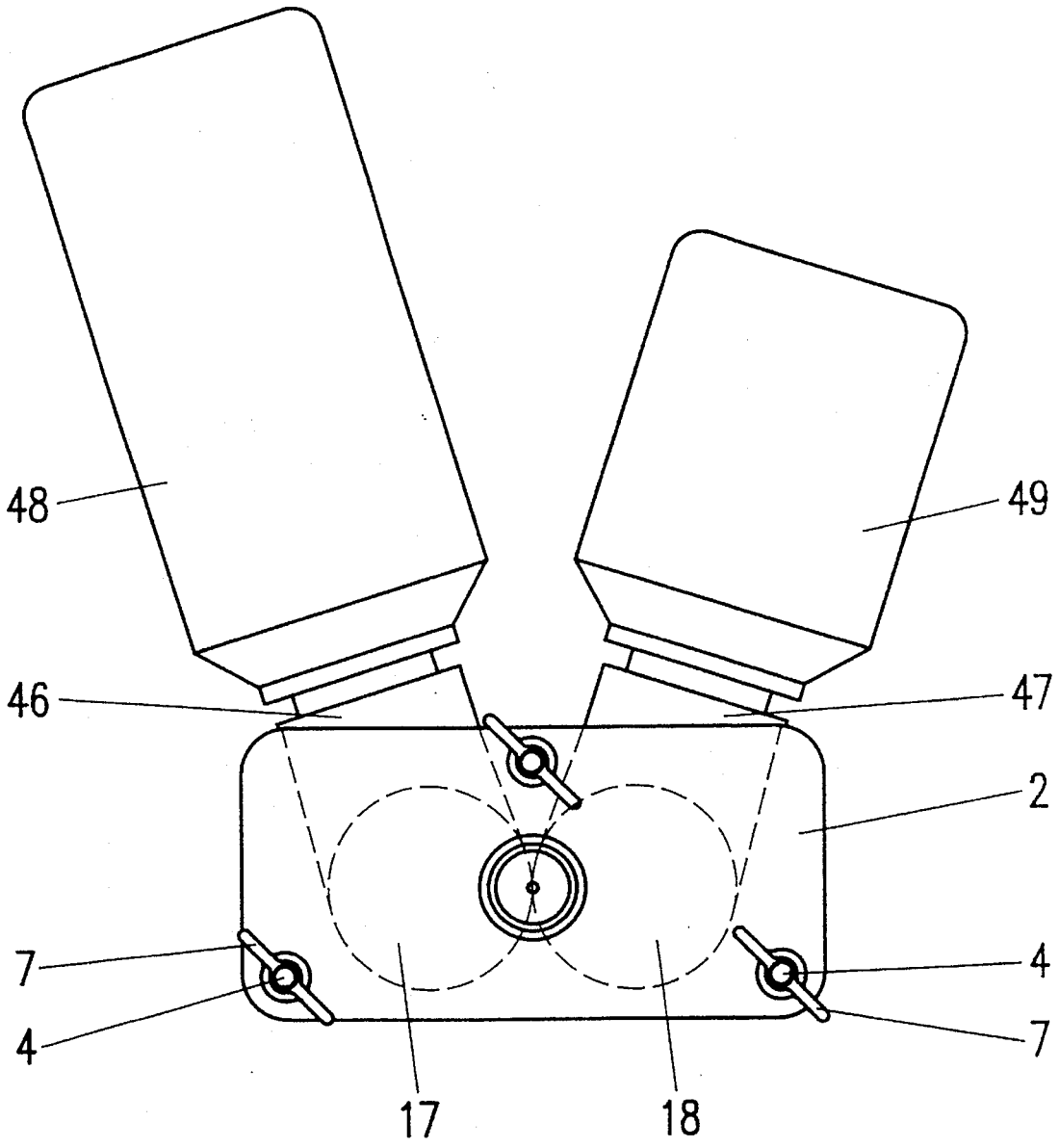
FIG. 4 shows an embodiment of the appliance according to the invention in a front view.

FIG. 4 shows a possible embodiment of a dispensing appliance in a front view. Front frame plate 2 with three frame rods 4 and the corresponding wing nuts 7 as well as outlet 9 are visible. Indicated by dotted lines are the two cylinders 17 and 18 with their respective inlet ports 46 and 47 whose longitudinal axes form an angle of approximately 35°. The inlet ports are designed to receive storage containers 48 and 49 in a detachable manner.

This V-shaped arrangement of the inlet ports 46, 47 with their threads **46*a*, 47*a*** respectively allows the use of storage containers having a relatively large capacity and diameter and at the same time a minimal distance between the inlet ports, which results in a minimal tilting moment of the drive.

As an alternative, it is possible to dispose the inlet ports at an angle and to provide the inlet ports with bent connecting pieces thus that the storage cylinders are disposed parallel to each other.

In the present example, the inlet ports and the outlets of the storage containers have the same diameters, but it is understood that these diameters can also differ from each other, especially in order to prevent any confusion of the storage containers. The special container for the lubricating liquid is generally disposed behind the two storage containers.

Figure 5A:
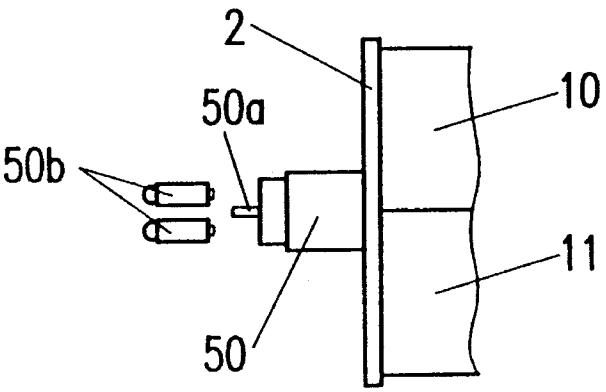
FIG. 5A shows a detail of an alternative embodiment.
Figure 5:
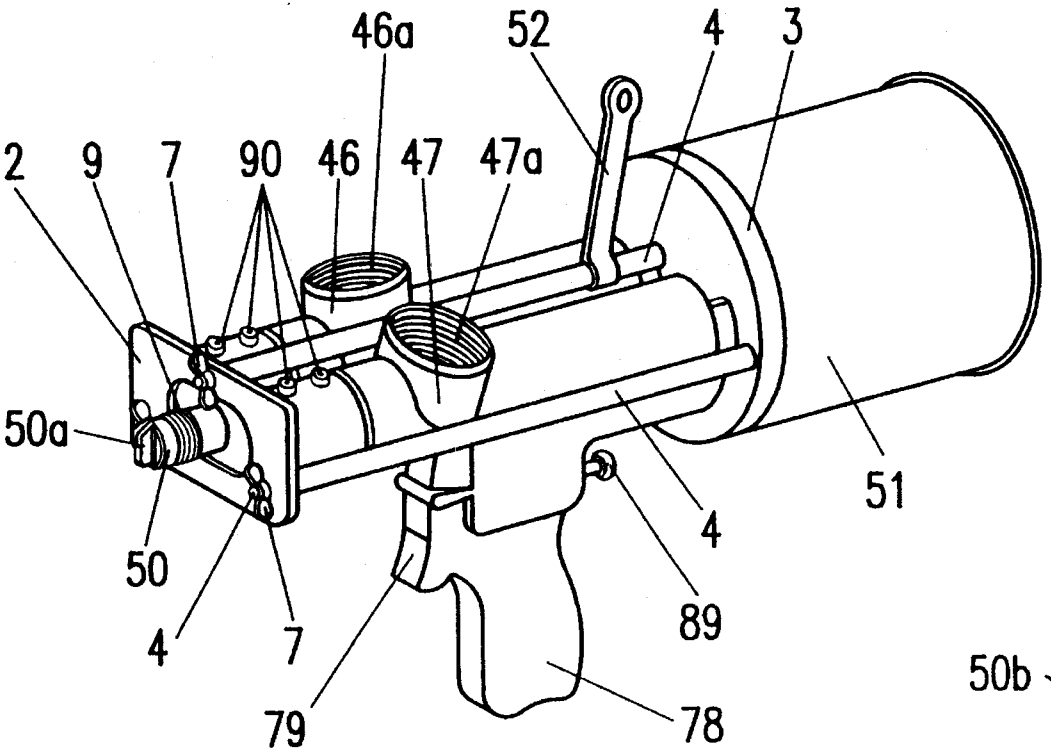
FIG. 5 shows the appliance of FIG. 4 in a perspective view.

In FIG. 5, the embodiment of a dispensing appliance shown in FIG. 4 is illustrated in a perspective view without the storage containers. Here, a dispensing tube 50 is shown around common outlet 9, which may be connected to a static mixer. FIG. 5 shows further that it is possible to provide the housing with a removable front part **14*b* comprising the front end 14*a* and which facilitates to service the front seals and in particular the front check valves 21. It is also shown that this front part 14*b* may contain air vent screws 90** for closing air vents at the highest points of the cylinders so as to be able to bleed off air within the metering cylinders, check valves, and outlet area.

In FIG. 5A the common, subdivided outlet 50 is provided with a partition wall **50*a*. It may be advantageous or necessary to provide one or both sides of the outlet nose with additional check valves 50*b*** to stop low viscosity materials from flowing out of the outlet area, or to contain a high ratio liquid within the outlet nose since loss would be critical, or to stop one component from entering back into another outlet area, or as secondary check valves as back up for primary check valves.

In FIG. 5, rear frame plate 3 as well as a drive unit 51 are visible. This appliance further comprises a longitudinally displaceable and lockable suspending device 52 which allows to suspend the appliance in a longitudinally balanced position, resulting in a small tilting moment and good handling thereof. Generally, the appliance is held by handle 78 and actuated by trigger 79. The handle further comprises a control device 89 which works in conjunction with the trigger operation for intermittent metering and mixing as opposed to metering and mixing with automatic reload each time. The control device 89 enables metering pumps to be locked in the forward position thus blanking off pump inlet areas (i.e., blocking the inlet openings) during storage container change over.

As mentioned in the introduction, drive shafts 15 and 16 may be actuated either by an electrically, pneumatically or manually operated drive. It is important for all types of drives that the drive shafts are guided as synchronously and frictionlessly as possible. An example of an electrically operated dispensing appliance is indicated in Swiss patent application no. 02 759/92-4, and a manually operated dispensing appliance e.g. in EP-A-408 494 (which corresponds to U.S. Pat. No. 5,137,181) or in Swiss patent application no. 02 758/92-2 (which corresponds to U.S. Pat. No. 5,392,956).

In all embodiments, the pump pistons are advanced when trigger 79 is actuated and are automatically retracted back to the starting position when the latter is released. Furthermore, it is advantageous to provide that the pistons are capable of being stopped in any given position, whereby an exchange of the storage containers is facilitated, in particular.

Figure 7:
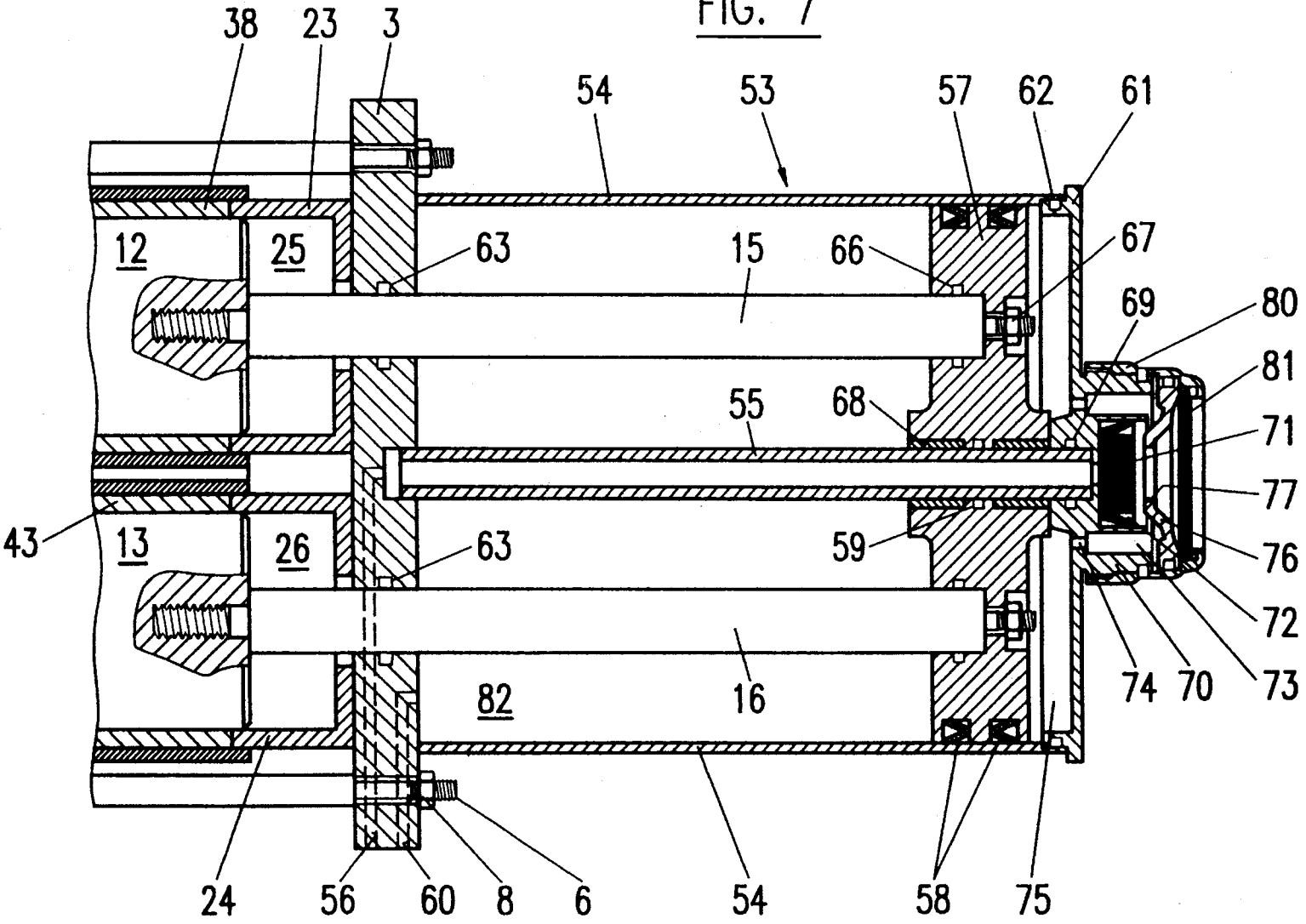
FIG. 7 shows a pneumatically operated appliance according to FIG. 1 in a sectional view.

In FIG. 7, an example of a pneumatic drive is indicated. Pneumatic drive 53 includes a cylinder 54 which is connected to rear frame plate 3 and comprises an inner, fixed guiding tube 55 which serves both as a guide and at the same time as a supply duct for the compressed gas in order to thrust piston plate 57 forward. The compressed gas passes through the guiding tube, one end of which is embedded in frame plate 3 together with supply duct 56 and the other end of which is embedded by means of a seal 69 in a socket 70 of cylinder bottom 61, and to a rubber-elastic shuttling member 71 which is pushed back under the pressure of the compressed gas and whose lip seal 72 is pressed towards the shuttling member, so that the compressed gas passes through a compartment 73 of the socket and through outlets 74 into the rear cylinder cavity 75 in order to advance the piston plate.

A closure 80 is screwed to socket 70, the closure comprising an end piece 76 with a venting bore 77 and a filter disk 81 which also serves as a sound absorber.

When switching over a non-represented control valve by releasing trigger lever 79, the compressed gas passes through second supply duct 60 into drive cylinder 82 and acts upon the piston plate which returns the pump pistons by means of drive shafts 15 and 16.

Moreover, when trigger lever 79 is released, guiding tube 55 is vented through duct 56, and shuttling member 71 is pushed to its forward position and against guiding tube 55, so that the air contained in rear cylinder cavity 75 is allowed to escape through compartment 73 and venting bore 77.

The two drive shafts 15 and 16 are secured by means of a thread and a nut 67 in a respective passage in piston plate 57 which is provided with a bidirectionally active external seal 58 and with an internal seal 59 as well as with guiding bushings 68. Drive shafts 15 and 16 are sealed in rear frame plate 3 by seals 63 and in piston plate 57 by seals 66. Screwed-on cylinder bottom 61 is provided with a seal 62.

There are applications where a determined, adjustable metering is, advantageous, which is e.g., achieved by a stroke limitation of the pump pistons. In the case of an electric drive, a stroke limitation is relatively easily obtained by virtue of the electric motor drive circuitry, while mechanical means can be provided in the case of a manual drive, the means being adjustable from the outside and acting upon the pump piston stroke to limit the same.

In FIGS. 5 and 8, adjusting means for the pneumatically operated appliance according to FIG. 7, are indicated, only a section of the appliance being illustrated in the present figure. Rear frame plate 3 with schematically indicated pneumatic drive 53 as well as handle 78 including trigger 79 are visible. Pump assembly 11 has been deleted, so that only pump assembly 10 remains visible in housing 14. In this embodiment, only two frame rods 4 are provided, for example one above the other, vertically. Moreover, inlet 85 for the distinct lubricating liquid container and inlet 47 for storage container 49 are represented.

In the present case, the adjusting means consist of a bar 86 which is secured in piston plate 57 of the drive cylinder and positioned as close as possible to the upper frame rod 4, and of an adjustable length stop 87 which is positioned on the upper frame rod 4. Bar 86 is sealed within rear frame plate 3. Other adjusting means are possible, however, as well as a scale in order to display different dispensing volumes.

I claim:

1. A dispensing appliance for at least two components, comprising:

a respective pump assembly for each component, each of said pump assemblies having an inlet and an outlet, said inlets being connected to a detachable container which holds one of said components, and the outlets of said pump assemblies ending in a common outlet, wherein said pump assemblies are held in a frame which can be dismantled and reassembled, said frame comprising a respective frame plate both on a dispensing side and on a drive side thereof, the plates being detachably connected to each other and mutually adjustable by means of frame rods and nuts.

2. The dispensing appliance of claim 1, wherein said pump assemblies each comprise a piston and a cylinder and are disposed inside said frame in a housing having a common outlet but separate outlet channels for each cylinder, and wherein the cylinders of said pumps assemblies have equal lengths.

3. The dispensing appliance of claim 2, wherein the housing comprises a detachable front part comprising a front end.

4. The dispensing appliance of claim 3 wherein at least one side of said common outlet is provided with a check valve.

5. The dispensing appliance of claim 2, wherein said outlet channels have cross-sections which are proportional to their associated cylinders.

6. The dispensing appliance of claim 1, wherein the piston does not have a separated sealing means mounted thereon.

7. The dispensing appliance of claim 1, wherein said inlets each comprise an inlet port having a longitudinal axis, the longitudinal axes being arranged in a V-shaped configuration to form an angle of 20° to 90°.

8. The dispensing appliance of claim 7, wherein the inlet ports are provided with means such that longitudinal axes of the detachable containers are arranged parallel to each other.

9. The dispensing appliance of claim 8, wherein said inlet ports and the outlets of said detachable containers have different respective diameters.

10. The dispensing appliance of claim 1, further comprising a suspending device mounted to said frame which is longitudinally displaceable and lockable for suspending the appliance in a longitudinally balanced position.

11. The dispensing appliance of claim 1, wherein said pump assemblies each comprise a piston and a cylinder, and further comprising a trigger lever and means for advancing said pistons when the trigger lever is actuated and retracting said pistons back to an initial position automatically when said trigger lever is released.

12. The dispensing appliance of claim 11, wherein said advancing means comprises a control device at a handle acting in conjunction with the trigger lever for intermittent advancing of said pistons.

13. The dispensing appliance of claim 11, wherein said advancing means comprises means for stopping said pistons in any given position, including a position in which said pistons block said inlets.

14. The dispensing appliance of claim 1, wherein said pump assemblies each comprise a piston and a cylinder, and further comprising means for adjustably limiting a stroke of said pistons within said cylinders.

15. The dispensing appliance of claim 1, further comprising spring-loaded valve balls in fluid communication with said cylinders for evacuating air from an upper portion of said cylinders adjacent said inlets.

16. The dispensing appliance of claim 1, further comprising a drive shaft operably connected to each pump assembly and an electric drive acting upon the drive shafts.

17. The dispensing appliance of claim 1, comprising a drive shaft operably connected to each pump assembly and a manually operated drive acting upon the drive shafts.

18. The dispensing appliance of claim 1, comprising a drive shaft operably connected to each pump assembly and a compressed gas drive acting upon the drive shafts.

19. The dispensing appliance of claim 18, wherein the compressed gas drive comprises a drive cylinder which is secured to a rear frame plate disposed on a drive side of said frame and is terminated by a cylinder bottom, said drive cylinder being provided with a centrally disposed guiding tube secured in said frame plate and in said cylinder bottom, said guide tube serving as a supply duct for a compressed gas for advancing a piston plate which is disposed in said drive cylinder, said piston plate being guided by a wall of the drive cylinder and by said guiding tube, said piston plate comprising sealing means and receiving said two drive shafts the other ends of which are secured to pistons of said pump assembly, and wherein said rear frame plate comprises a first compressed gas supply duct connected to said guiding tube for supplying gas for an advancing stroke of said piston plate, and a second compressed gas supply duct for supplying gas for a return stroke of said piston plate.

20. The dispensing appliance of claim 19, further comprising outlets leading from said guiding tube to a rear drive cylinder cavity behind said piston plate, and a rubber-elastic shuttling member having a lip seal disposed behind said guiding tube, the shuttling member releasing said outlets leading to the rear drive cylinder cavity under the action of compressed gas from said first gas supply duct.

21. The dispensing appliance of claim 19, wherein said pump assemblies each comprises a piston and a cylinder, and further comprising a means for adjustably limiting a stroke of said pistons within the cylinders, said adjusting means comprising a bar having a first end secured to said piston plate and a second end projecting from said rear frame plate adjacent the housing of said pump assembly, the adjusting means further comprising an adjustable length stop cooperating with said bar.

22. The dispensing appliance of claim 21, wherein said bar is guided and sealed in said rear frame plate and is positioned near an upper frame rod of said frame, and wherein the adjustable length stop is positioned on the upper frame rod.

23. A dispensing appliance for at least two components, comprising:

a respective pump assembly for each component, each of said pump assemblies having an inlet and an outlet, said inlets being connected to a detachable container which holds one of said components, and the outlets of said pump assemblies ending in a common outlet, wherein said pump assemblies are held in a frame which can be dismantled and reassembled;

wherein each of said pump assemblies comprises a piston and a cylinder, said cylinder having a cylinder head piece with an outlet channel for each cylinder which is blocked by a spring-loaded valve ball, and a rear closure piece, as well as a plurality of cylinder segments between said cylinder head piece and said rear closure piece with seals on and between said segments, said cylinder segments being dismountable and arranged to be pressed against each other by means of said frame.

24. The dispensing appliance of claim 23, wherein each of said pump assemblies and a front part of said housing are provided with air vents closed by screws.

25. The dispensing appliance of claim 23, wherein at least one of said segments is provided with an internal groove communicating with a container for wetting said piston.

26. The dispensing appliance of claim 23, wherein the rear closure pieces are designed as leakage compartments which are capable of being viewed from the outside.

27. A dispensing appliance for dispensing at least two components, comprising:

a respective pump assembly for each component, each of said pump assemblies having an inlet for receiving a component from a respective supply container, and an outlet for dispensing the component from said pump assembly;

said pump assemblies each comprising a piston and a cylinder, said cylinder comprising a plurality of dismountable, coaxial cylinder segments with seals between said segments, said seals providing means for preventing leakage of the dispensed components between the pistons and the cylinders.

* * * * *